United States Patent [19]

Becker

[11] Patent Number: 4,976,361

[45] Date of Patent: Dec. 11, 1990

[54] MOBILE CRANE COMPRISING A TELESCOPIC BOOM

[75] Inventor: Rudolf Becker, Ehingen/Donau, Fed. Rep. of Germany

[73] Assignee: Liebherr-Werk Ehingen GmbH, Donau, Fed. Rep. of Germany

[21] Appl. No.: 327,887

[22] Filed: Mar. 23, 1989

[30] Foreign Application Priority Data

Mar. 23, 1988 [DE] Fed. Rep. of Germany ..... 3809790
Apr. 11, 1988 [DE] Fed. Rep. of Germany ..... 3812032
Nov. 30, 1988 [DE] Fed. Rep. of Germany ..... 3840408

[51] Int. Cl.[5] ..... B66C 23/04; B66C 23/26

[52] U.S. Cl. ..... 212/231; 212/182; 212/244

[58] Field of Search ..... 212/186, 261, 264, 230, 212/231, 238, 267, 182

[56] References Cited

U.S. PATENT DOCUMENTS 2,895,623 7/1959 Urbanowicz ..... 212/186
3,792,781 2/1974 Blase et al. ..... 212/238
4,049,238 9/1977 Brown ..... 212/264
4,460,098 7/1984 Scherman ..... 212/231
4,492,312 1/1985 Poock ..... 212/186

FOREIGN PATENT DOCUMENTS 2628016 2/1977 Fed. Rep. of Germany ..... 212/231
1382920 11/1964 France ..... 212/238
368176 3/1972 U.S.S.R. ..... 212/231
4934426 2/1976 U.S.S.R. ..... 212/231

*Primary Examiner*—Joseph F. Peters, Jr.
*Assistant Examiner*—R. B. Johnson
*Attorney, Agent, or Firm*—Fleit, Jacobson, Cohn, Price, Holman & Stern

[57] ABSTRACT

A mobile crane is disclosed which comprises a telescopic boom, which is pivoted to the rotating superstructure or rotating deck of the crane and is adapted to be luffed by a luffing cylinder, which is pivoted to the boom and the rotating deck. A guying yoke is pivoted on the rear of the telescopic boom near the middle of its base box. Two axially aligned spaced apart rope pulleys are rotatably mounted at the outer end of the guying yoke. A reversing rope pulley is provided adjacent to the top end of the telescopic boom. Also, a winch is provided with a rope, which serves to guy the telescopic boom and extends around one rope pulley of the guying yoke to the upper reversing rope pulley and back around the other rope pulley of the guying yoke to a fixed point. The winch and the point to which the rope is fixed are disposed on mutually opposite sides of the telescopic boom adjacent to the pivotal axis of the boom. The guying yoke is restrained by a hydraulic piston-cylinder unit, which is pivoted at one end to the guying yoke above the pivotal axis of the latter and is pivoted at the other end to the base box near the middle thereof between the pivotal axes of the guying yoke and the telescopic boom.

5 Claims, 4 Drawing Sheets

MOBILE CRANE COMPRISING A TELESCOPIC BOOM

BACKGROUND OF THE INVENTION

1. Field of the Invention

This invention relates to a mobile crane comprising a telescopic boom, which is pivoted to the rotating superstructure or rotating deck of the crane and is adapted to be luffed by a luffing cylinder, which is pivoted to the boom and the rotating deck. Also provided are a guying yoke, which is pivoted on the rear of the telescopic boom near the middle of its base box, two axially aligned, spaced apart rope pulleys, which are rotatably mounted at the outer end of the guying yoke, a reversing rope pulley, which is provided adjacent to the top end of the telescopic boom, and a winch provided with a rope, which serves to guy the telescopic boom and extends around one rope pulley of the guying yoke to the upper reversing rope pulley and back around the other rope pulley of the guying yoke to a fixed point.

2. Description of the Prior Art

Published German application 31 13 763 discloses a mobile crane which is of the kind described hereinbefore and in which the winch and the point to which the rope is fixed are disposed on mutually opposite sides of the telescopic boom approximately on the pivotal axis on which the guying yoke is pivoted to the telescopic boom. The guying yoke is guyed to the telescopic boom by ropes of constant length, which extend from the outer ends of the guying yoke to the bottom point of the base box of the telescopic boom. To permit the use of the additional ropes for exerting tension on the guying yoke, the additional ropes may be secured to the piston rod of a tension cylinder, which is pivoted to the base of the base box.

The guying telescopic boom of the mobile crane known from Published German application 31 13 763 involves time-consuming operations because the boom is guyed not only by the rope that is tensioned by the winch but also by ropes of constant length, which are permanently installed and may additionally be tensioned by a hydraulic cylinder. In the known mobile crane, the winch assembly must be controlled depending on the length of the boom and/or on the load and/or the inclination of the boom, and additional work is required for that purpose.

SUMMARY OF THE INVENTION

It is an object of the invention to provide a mobile crane which is of the type described first hereinbefore and which has a telescopic boom that can be guyed in a simpler manner.

In a mobile crane which is of the kind described first hereinbefore that object is accomplished in accordance with the invention in that the winch and the point to which the rope is fixed are disposed on mutually opposite sides of the telescopic boom adjacent to the pivotal axis of said boom and that the guying yoke is restrained by a hydraulic piston-cylinder unit, which is pivoted at one end to the guying yoke above the pivotal axis of the latter and is pivoted at the other end to the base box near the middle thereof between the pivotal axes of the guying yoke and the telescopic boom.

As the telescopic boom of the mobile crane in accordance with the invention is raised and extended or when the boom has been raised and extended, the piston-cylinder unit can be actuated to raise the guying yoke so that the piston-cylinder unit does not serve only as a restraining cylinder but also as a raising cylinder. Because the telescopic boom is guyed only by means of the winch, simpler rope means and simpler rope-guiding means will be sufficient.

The winch and the point to which the rope is fixed may be provided on the rotating deck. In that case the fixed point and the winch must be so arranged that the rope lengths which are to be taken up during a luffing of the boom will be minimized and that the lengths are within the extent that can be taken up owing to the elasticity of the rope and of the boom structure.

Rope lengths which are to be taken up owing to a luffing operation will be avoided if the winch and the fixing point for the rope are directly mounted on the base box of the telescopic boom.

The fixing point for the rope must be provided on the base box for the telescopic boom or on the rotating deck at such a location that the rope extends from said fixing point approximately in the same direction from the winch. As a result, the lever arm which is constituted by the guying yoke will have a large length from the pivotal axis of the guying yoke so that large rearwardly directed torques will be produced.

Such a geometry is suitably selected that the lower one of the two angles between the ropes and the guying yoke is smaller than the upper. In that case the component of force which is exerted on the free end of the guying yoke will exert tension on the piston-cylinder unit for restraining said yoke. But said relation of angles cannot always be achieved if the telescopic boom has been extended only to a relatively short length.

In a particularly desirable embodiment the winch is provided with an adjustable brake, which imposes a predetermined limit on the torque which is exerted by the winch and which will slip and maintain that torque when said torque would otherwise be exceeded. In that case the torque for which the brake is adjusted will limit the force which can be exerted on the rope. If a stronger force is exerted, the additional load will be taken up by the telescopic boom, which is designed to take up bending moments.

The brake for limiting the torque that is exerted by the winch may consist of a spring-biased brake.

In accordance with a further feature of the invention a portion of the guying rope extends between two rope pulleys of the guying yoke and is trained in the shape of a loop around a reversing and tensioning pulley, which is mounted on the lower portion of the guying yoke. The reversing and tensioning pulley is elastically biased and that bias is selected to ensure that the tensioning pulley will be pulled toward the rope pulleys of the guying yoke when a sufficiently high tension is exerted on the rope. If the guying rope is reeved in such a configuration that the length of the rope will change, e.g., during a luffing of the boom because a small length of rope, depending on the luffing angle, is then wound on or unwound from the drum of the tensioning winch, the tensioning pulley will be moved to compensate the change of the tensile force exerted on the rope.

Such a geometry will suitably be selected that the tension of the guying rope will not substantially be changed even during a luffing of the boom because the point to which the guying yoke is fixed is sufficiently spaced behind the pivot so that a shortening of the rope will substantially be compensated. In accordance with the invention the guying rope is reeved in such a manner that any changes of the length of the guying rope will be compensated because the rope has been fixed at a properly selected location so that a compensation will be effected to prevent an undesired winding or unwinding action of the drum of the guying winch during a luffing.

Because small changes of the guying rope, which are not avoided owing to the selected geometry, can also be compensated by the tensioning, the tension of the guying rope need not be controlled by the winch for the guying rope.

The bearing means for the reversing and tensioning pulley may be biased by a spring in a direction which is opposite to the direction in which said pulley is extended.

In accordance with a further feature of the invention the reversing and tensioning pulley is rotatably mounted on a piston rod, which is associated with a cylinder having a chamber which is supplied from a pressure accumulator with compressed gas acting in a direction which is opposite to the direction in which the reversing and tensioning pulley can be extended.

DETAILED DESCRIPTION OF THE PREFERRED EMBODIMENTS

Illustrative embodiments of the invention will now be described more in detail with reference to the drawings.

Figure 1:
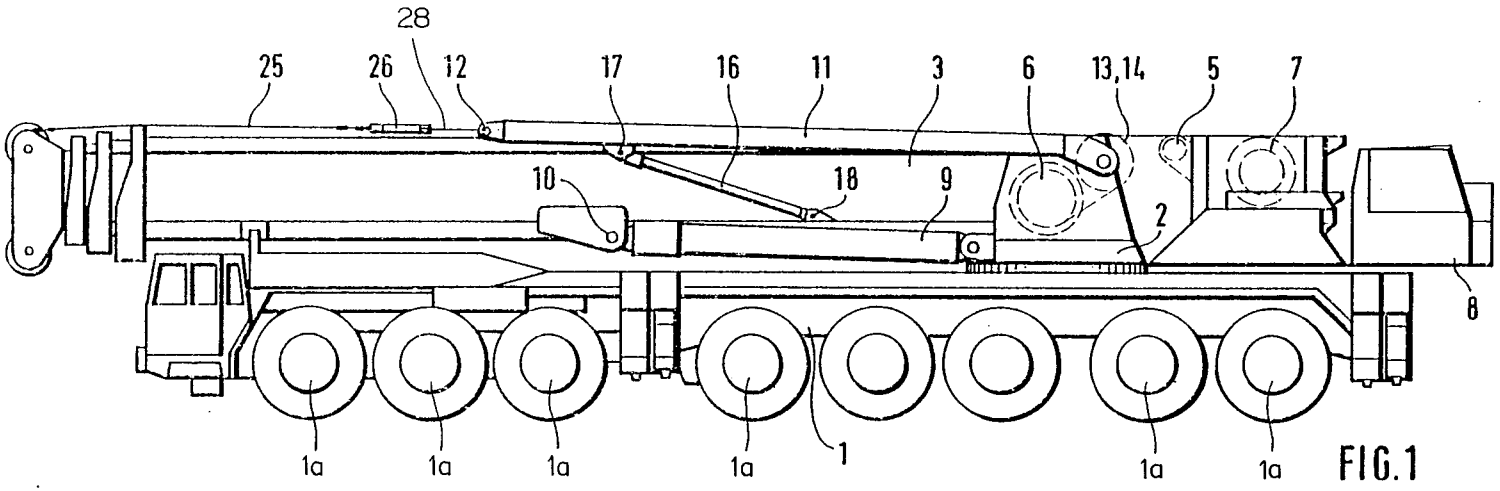
FIG. 1 is a side elevation view showing a mobile crane in a position for transportation in which the boom has been retracted and swung down.
Figure 2:
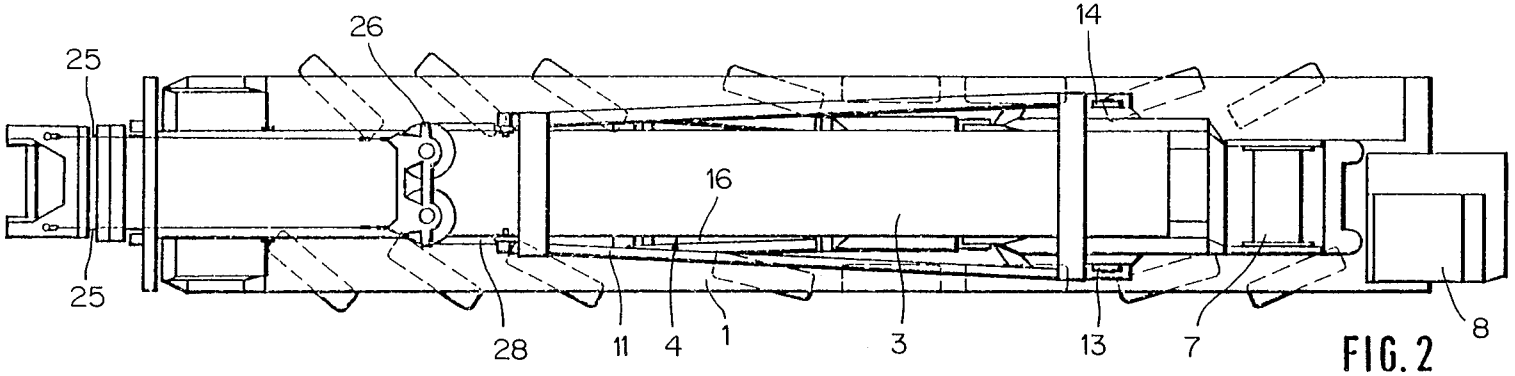
FIG. 2 is a top plan view showing the mobile crane of FIG. 1.
Figure 4:
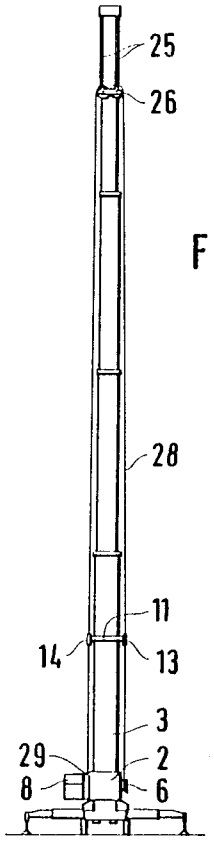
FIG. 4 is a rear view showing the mobile crane of FIG. 3.

The mobile crane shown in FIGS. 1 to 4 comprises an undercarriage 1 having a plurality of driven axles. Six of said axles 1*a* can be steered as is shown in FIG. 2. A rotating deck 2 is mounted on the undercarriage 1 in a manner which is known and for that reason will not be described in detail. The base box 3 of the telescopic boom 4 is pivoted to the rotating deck 2 on a suitable mounting structure on the pivot 5. The rotating deck 2 carries also the winch 6 for guying the boom 4 and the hoist winch 7. The cab 8 for the operator of the crane is mounted as shown on the rotating deck 2 and is shown in FIG. 1 in a swung-down position for road travel and in FIG. 3 in an operating position. The luffing cylinder 9 is pivoted to the rotating deck 2 and is provided with a piston rod, which is pivoted to the base box 3 by hinge 10. The guying yoke 11 is pivoted to the base box 3 by the hinge 12. The guying yoke 11 is pivoted to the base box 3 and is movably mounted on the transverse pivot 12 of the base box 3. Rope pulleys 13, 14 are rotatably mounted at the top ends of the legs of the guying yoke 11. The guying yoke 11 can be erected and held in an erected position by a hydraulic cylinder 16, which is provided with a piston rod that is pivoted to the guying yoke 11 by the hinge 17. The hydraulic cylinder 16 is pivoted to the base box 3 by the hinge 18. Boom sections 20, 21, 23 which also consist of box sections can be telescopically extended out of the base box 3 in known manner. The uppermost section 23 of the boom is provided with a boom head 24, to which ropes 25 are connected which at their lower end carry a pulley block 26, which is provided with two reversing rope pulleys.

When boom or box sections 20, 21, 23 have been telescopically extended and the crane is in an operating condition, the guying rope 28 extending from the winch 6 is trained around the rope pulley 13 and then extends to the rope pulleys of the block 26 and from the latter extends to and is trained around the rope pulley 14 and extends from the latter to the fixed point 29 on the rotating deck 2. Adjacent to the pivot 5 the winch 6 and the fixed point 29 are provided on the rotating deck 2 in a manner which is apparent from FIG. 4. The lateral distance between the rope drum of the winch 6 to the fixed point 29 is approximately as large as the lateral distance between the rope pulleys 13, 14 provided at the outer ends of the legs of the guying yoke 11. This will ensure that the courses of the guying rope 28 will extend along substantially parallel straight lines, as FIG. 4 makes clear.

The arrangement of the hoist rope 30 is of conventional type and for this reason will not be explained.

When the telescopic boom 4 has been raised and extended, the winch 6 is operated to tension the guying rope 28 initially with a small force e.g., of 500 to 1000 kg. The brake of the winch is subsequently applied so that the initial tension of the guying rope 28 will be preserved. Owing to the lifting forces acting on the telescopic boom during the operation of the crane the tension of the guying rope 28 will then be increased. When an upper limit of, e.g., 20,000 kg is imposed by the adjusted brake on the rope tension, the brake will slip when the total tensile force exerted by both courses of the rope exceeds 40,000 kg. When the torque which has been adjusted for the winch is exceeded, the rope will be withdrawn from the winch in the additional length which is required. As a result, the boom will take up by an elastic deformation the excessive force which is not on the winch. Bending stresses corresponding to the excessive force will then build up in the telescopic boom.

If a decrease of the load has caused the guying rope 28 to slacken, a retensioning of the guying rope 28 will not be required unless the geometry has been changed, e.g., by a change of the length of the boom.

As is apparent from FIG. 1 the guying yoke 11 is so arranged and mounted on the base box 3 of the telescopic boom that the guying yoke 11 when it has been swung down will not extend above the permissible height.

During or after the raising of the telescopic boom the hydraulic cylinder 16 is operated to raise the guying yoke 11 to its operating position. During that operation the brake for the winch 6 is open and the drive motor is rotating. A small internal pressure is suitably maintained in the drive motor so that the guying rope will not slacken as the telescopic boom is raised.

The guying yoke 11 is held only by the hydraulic cylinder 16 rather than by fixed guying ropes. The hydraulic cylinder 16 ensures the stability of the guying yoke 11.

Figure 3:
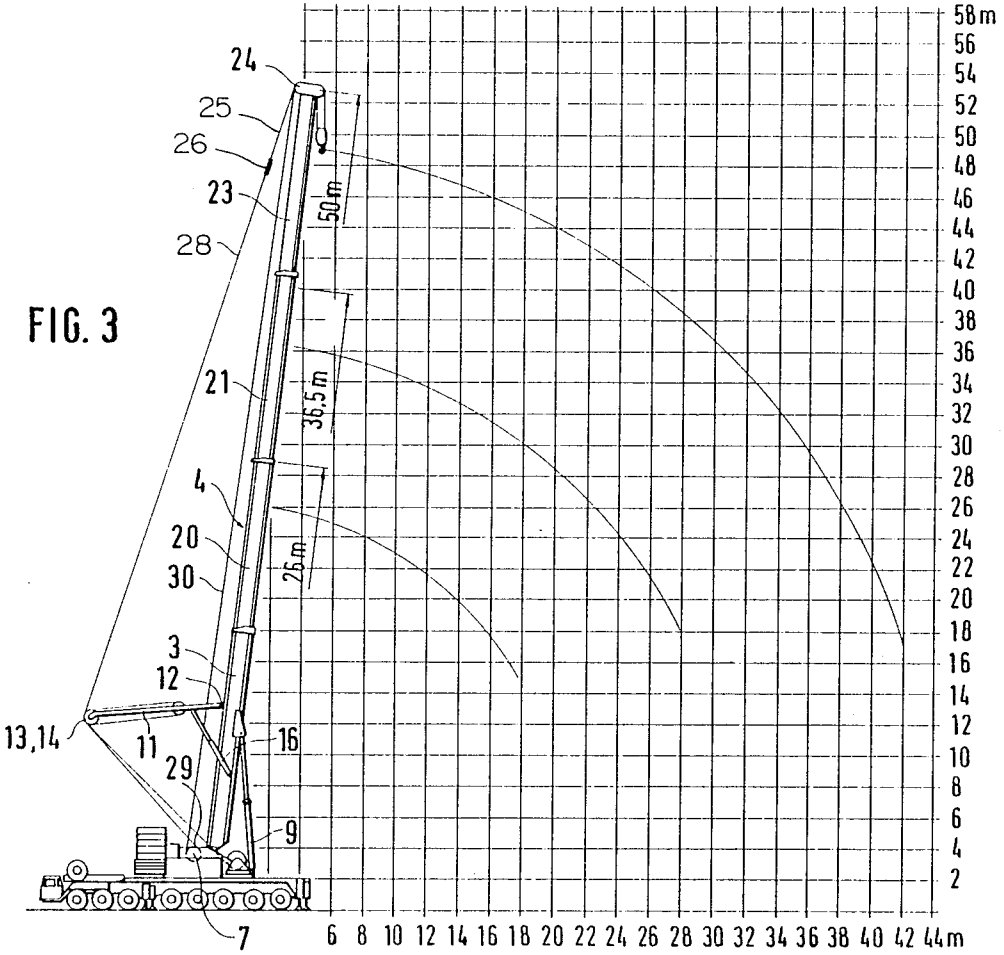
FIG. 3 is a side elevation showing the mobile crane in an operating position in which the boom is raised.
Figure 5:
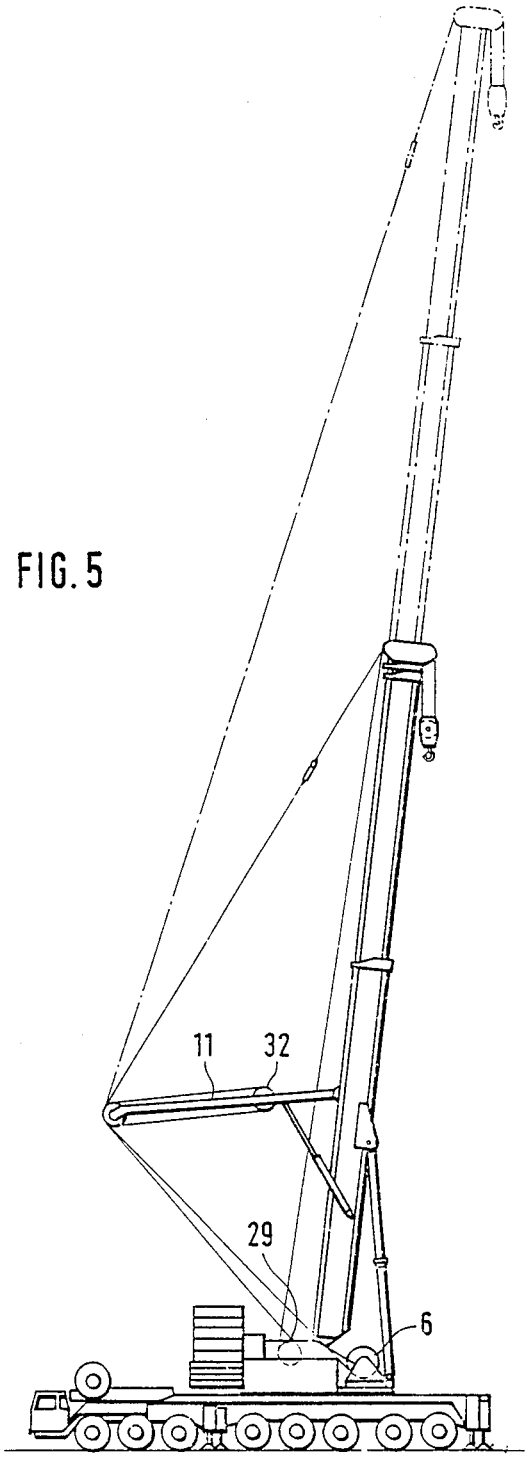
FIG. 5 is a side elevation which is similar to FIG. 3 and shows a mobile crane in which the guying rope is trained around a reversing and tensioning pulley, which is movably mounted on the guying yoke.

The angle between the guying yoke 11 and the guying rope 28 is smaller on the rear than in front so that the guying yoke tends to tilt forwardly under a load. As a result, a tension is exerted on the cylinder 16. Because the piston rod associated with the hydraulic cylinder engages the outer stop, the guying yoke cannot move further. As shown in FIGS. 3 and 5, the geometry is selected so that a lower angle of two angles between the rope 28 and guying yoke 11 is smaller than an upper one of the two angles.

The luffing or bending of the telescopic boom under a load will not result, on principle, in a change of the geometry of the guying rope because the rope lengths will not be changed in spite of the change of the angle of sling of the rope around the pulleys and the winch. Any small length changes will be taken up by elastic deformation.

The guying of the telescopic boom by two courses of the guying rope as has been described with reference to the drawing can be replaced by a rope having more courses, e.g., three or four courses, if the arrangement of the rope pulleys and the configuration of the rope are properly changed.

Figure 6:
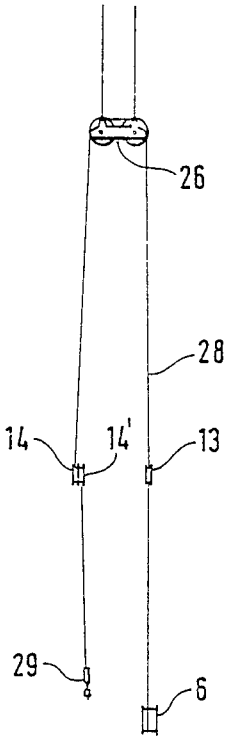
FIG. 6 is a top plan view showing the reeved guying rope.
Figure 7:
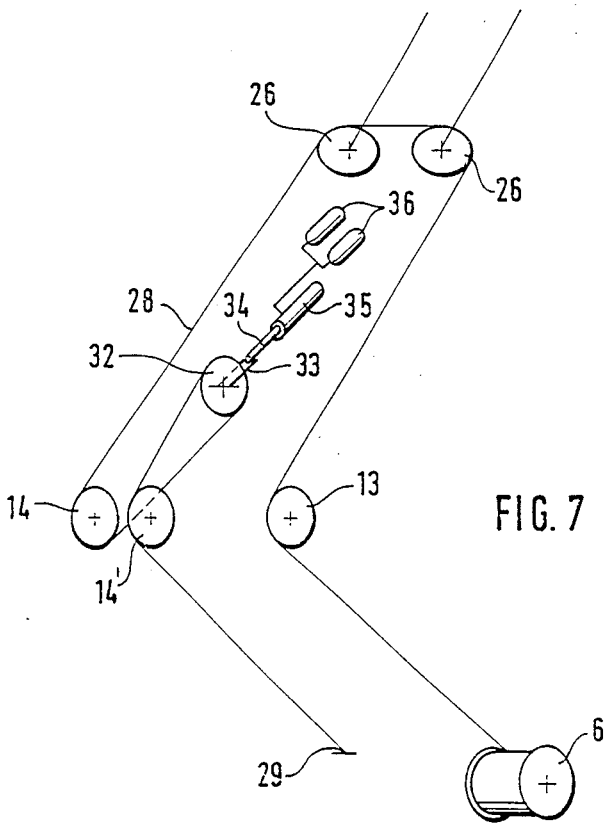
FIG. 7 is a diagrammatic perspective view showing the reeved guying rope.

A changed embodiment of the mobile crane will now be explained with reference to FIGS. 5 to 7. That embodiment differs from the one shown in FIGS. 1 to 4 only in that the guying rope 28 is reeved to form a loop between two rope pulleys 14, 14' of the guying yoke 11 because the guying rope 28 is trained around a reversing and tensioning pulley 32 between said rope pulleys. The reversing and tensioning pulley 32 is rotatably mounted in a bifurcated holder 33, which is hinged to the top end of the piston rod 34 that is associated with the cylinder 35. The reversing and tensioning pulley assembly shown in FIG. 7 is mounted on the lower portion of the guying yoke 11. By the compressed gas accumulators 36 the cylinder 35 is biased to oppose the extending of the reversing and tensioning pulley 32. The cylinder 35 is hinged to the guying yoke 11.

It is apparent from FIGS. 3 and 5 that the point 29 to which the guying rope 28 is fixed is sufficiently spaced from the pivot of the telescopic boom on the rear so that a shortening of the rope during a luffing will be compensated. The winch for the guying rope will be arranged in front of the pivot, and the guying rope 28 extends from the winch 6 to the reversing rope pulley 13 mounted on the guying yoke 11. As a result, the guying rope is reeved in such a geometry that any changes of the length of the guying rope caused by a luffing will be compensated as exactly as possible without a need for readjusting means for maintaining a predetermined rope tension.

Any tension changes which may be due to small length changes of the guying rope will be compensated by the tensioning pulley 32.

Figure 8:
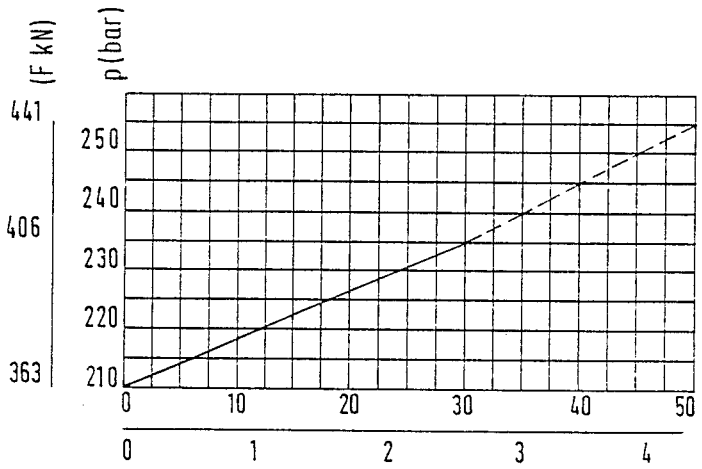
FIG. 8 is a force-displacement graph for the spring which biases the reversing and tensioning pulley.

The displacement-force diagram of the compressed gas spring consisting of the piston-cylinder unit 34, 35 and the compressed gas accumulators 36 is apparent from FIG. 8.

I claim:

1. A mobile crane comprising an undercarriage, a deck rotatably mounted on the undercarriage, a telescopic boom having a plurality of boom sections and a base box pivotably mounted on the rotating deck, a luffing cylinder pivotably mounted on the boom and the rotating deck for pivoting the boom, a guying yoke pivotably mounted on the telescopic boom near a middle of the base box, said guying yoke having two legs located on opposite sides of the base box with one end of the two arms pivotably mounted on the base box, two axially aligned spaced apart rope pulleys rotatably mounted at an outer free end of the two legs of the guying yoke, a winch mounted on the deck, a guying rope, a boom head located at an outer end of an outermost boom section, a pulley block suspended from said boom head and having two reversing rope pulleys, said guying rope extending from the winch around one rope pulley of the guying yoke, around one of the two reversing rope pulleys, around the other of said two reversing rope pulleys and back around the other rope pulley of the guying yoke to a fixed point located on the deck, the winch and the fixed point being disposed on mutually opposite sides of the telescopic boom, adjacent to a pivotal axis at which said boom is pivotably mounted on the deck, and the guying yoke being movable by a hydraulic piston-cylinder unit pivotably mounted at one end to the guying yoke at a point spaced from a pivotal axis at which the guying yoke is pivotably mounted to the base box and is pivoted at the other end to the base box near a middle thereof between the pivotal axis of the guying yoke on the base box and the pivotal axis of the telescopic boom on the deck.

2. A mobile crane according to claim 1, characterized in that such a geometry is selected that a lower one of two angles between said guying rope and the guying yoke is smaller than the upper one of the two angles.

3. A mobile crane according to claim 1, characterized in that a portion of the guying rope extends between two rope pulleys of the guying yoke and is trained in the shape of a loop around a reversing and tensioning pulley, which is mounted on the lower portion of the guying yoke.

4. A mobile crane according to claim 3, characterized in that means for the reversing and tensioning pulley are biased in a direction which is opposite to the direction in which said pulley is extended.

5. A mobile crane according to claim 3, characterized in that the reversing and tensioning pulley is rotatably mounted on a piston rod, which is operatively connected with a cylinder having a chamber which is supplied from a pressure accumulator with compressed gas acting in a direction which is opposite to the direction in which the reversing and tensioning pulley can be extended.

* * * * *